US009422491B2

(12) United States Patent
Schwarz et al.

(10) Patent No.: US 9,422,491 B2
(45) Date of Patent: Aug. 23, 2016

(54) SHAFT GASIFIER FOR OPERATING WITH HYPOSTOICHIOMETRIC OXIDATION

(75) Inventors: Armin Schwarz, Vechta (DE); Wilfried Richter, Vechta (DE)

(73) Assignee: BIG DUTCHMAN INTERNATIONAL GMBH, Vechta (DE)

( * ) Notice: Subject to any disclaimer, the term of this patent is extended or adjusted under 35 U.S.C. 154(b) by 314 days.

(21) Appl. No.: 14/005,926

(22) PCT Filed: Mar. 22, 2012

(86) PCT No.: PCT/EP2012/055082

§ 371 (c)(1),
(2), (4) Date: Jul. 15, 2014

(87) PCT Pub. No.: WO2012/126986

PCT Pub. Date: Sep. 27, 2012

(65) Prior Publication Data

US 2014/0338262 A1 Nov. 20, 2014

(30) Foreign Application Priority Data

Mar. 22, 2011 (DE) ..... 20 2011 004 328 U

(51) Int. Cl.
*B01J 7/00* (2006.01)
*C10J 3/82* (2006.01)
(Continued)

(52) U.S. Cl.
CPC .... *C10J 3/82* (2013.01); *C10J 3/20* (2013.01); *C10J 3/26* (2013.01); *F23B 90/06* (2013.01);
(Continued)

(58) Field of Classification Search
CPC ..... F23G 2201/303
See application file for complete search history.

(56) References Cited

U.S. PATENT DOCUMENTS 5,026,403 A 6/1991 Michel-Kim
5,318,602 A * 6/1994 Juch ..... C10J 3/26 110/229

(Continued)

FOREIGN PATENT DOCUMENTS

CN 1286759 3/2001
CN 101558133 10/2009

(Continued)

OTHER PUBLICATIONS

State Intellectual Property Office (SIPO) Office Action in Chinese Patent Application for Invention No. 201080066246.9 (PCT/EP2010/051947), in the name of Big Dutchman International GmbH (Jul. 8, 2013).

(Continued)

*Primary Examiner* — Imran Akram
(74) *Attorney, Agent, or Firm* — Price Heneveld LLP

(57) ABSTRACT

The invention relates to a shaft gasifier for producing fuel gas from solid carbonaceous material. The shaft gasifier comprising a shaft wall surrounding a shaft gasifier interior, a pyrolysis zone disposed in the shaft gasifier interior, the pyrolysis zone comprising a solid material feed opening for feeding solid carbonaceous material into the shaft gasifier and a solid material discharge opening for discharging partially gasified solid carbonaceous material and a gas discharge opening for pyrolysis gas, an oxidation zone which is disposed in the shaft gasifier interior and which is in thermal contact with the pyrolysis zone, the oxidation zone comprising a gas feed opening connected to the gas discharge opening of the pyrolysis zone for discharging pyrolysis gas out of the pyrolysis zone, and a gas discharge opening. The oxidation zone is disposed between the pyrolysis zone and the shaft wall.

10 Claims, 2 Drawing Sheets

Figure 1:
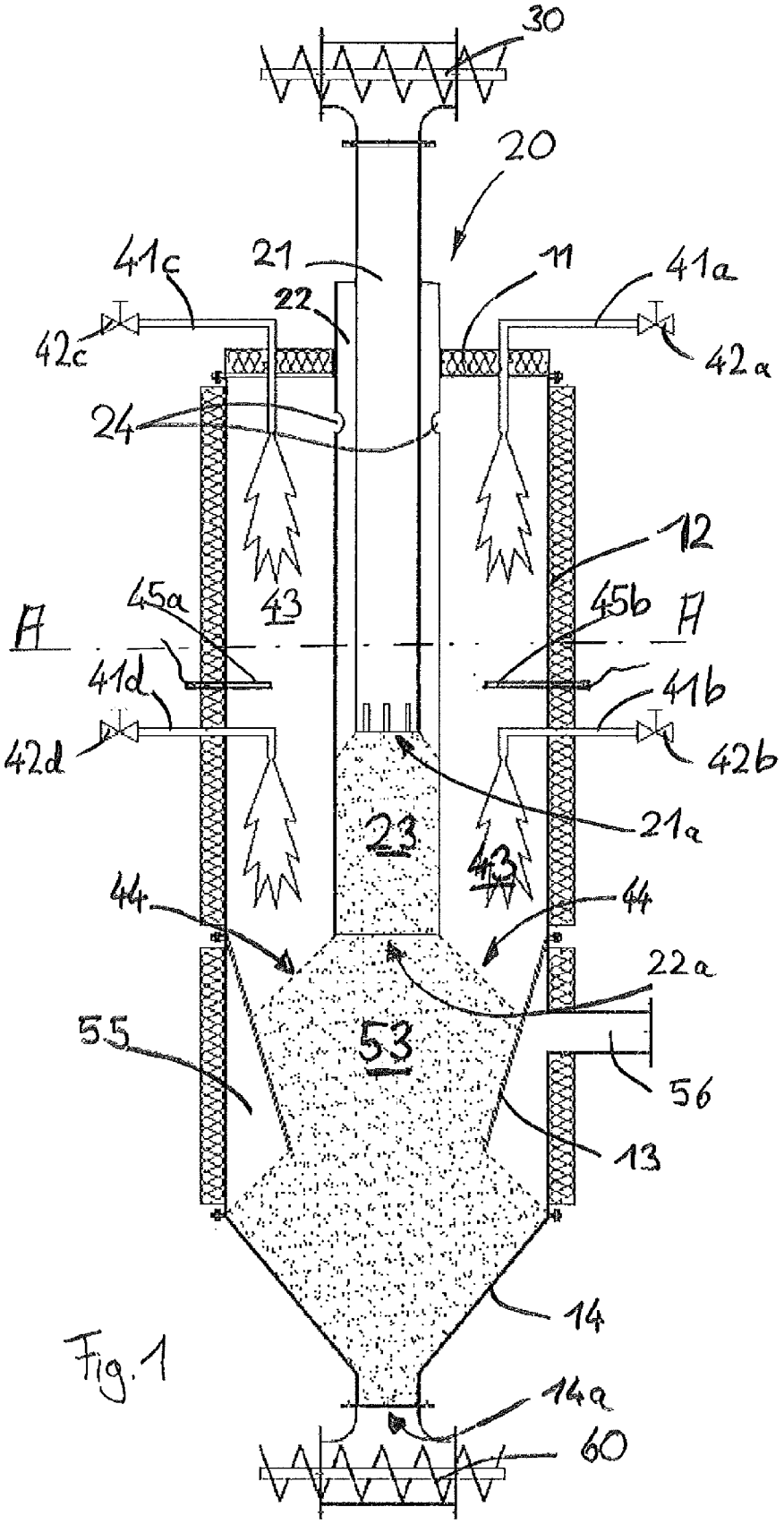

(51) Int. Cl.

| | |
|---|---|
| ***C10J 3/20*** | (2006.01) |
| ***C10J 3/26*** | (2006.01) |
| ***F23B 90/06*** | (2011.01) |
| ***F23G 5/027*** | (2006.01) |
| *C10J 3/66* | (2006.01) |
| *C10J 3/30* | (2006.01) |

(52) U.S. Cl.

CPC ..... *F23G 5/0276* (2013.01); *C10J 3/30* (2013.01); *C10J 3/66* (2013.01); *C10J 2200/152* (2013.01); *C10J 2300/0956* (2013.01); *C10J 2300/1207* (2013.01); *C10J 2300/1606* (2013.01); *C10J 2300/1609* (2013.01)

(56) References Cited

U.S. PATENT DOCUMENTS

| | | | | |
|---|---|---|---|---|
| 5,435,890 | A | 7/1995 | Munger | |
| 6,112,677 | A * | 9/2000 | Kuntschar | C10J 3/002 110/255 |
| 7,819,070 | B2 | 10/2010 | Rehmat | |
| 2006/0265954 | A1 * | 11/2006 | Dogru | C10J 3/22 48/197 R |
| 2007/0006528 | A1 | 1/2007 | Diebold et al. | |
| 2007/0012229 | A1 | 1/2007 | Rehmat et al. | |
| 2008/0172941 | A1 * | 7/2008 | Jancker | C10J 3/485 48/73 |
| 2008/0175769 | A1 * | 7/2008 | Goller | F28D 7/1669 422/201 |
| 2009/0260286 | A1 | 10/2009 | Sasauchi et al. | |
| 2009/0282738 | A1 | 11/2009 | Tharpe, Jr. | |
| 2010/0037519 | A1 * | 2/2010 | Patil | C10J 3/26 48/76 |
| 2011/0308155 | A1 * | 12/2011 | Paskach | C10J 3/463 48/77 |
| 2013/0097928 | A1 * | 4/2013 | Schwarz | C10J 3/06 48/87 |
| 2013/0185999 | A1 * | 7/2013 | Chen | C10J 3/74 48/111 |

FOREIGN PATENT DOCUMENTS

| | | |
|---|---|---|
| DE | 1037051 | 8/1958 |
| DE | 19846805 | 4/2000 |
| DE | 10258640 | 6/2004 |
| DE | 202006009174 | 11/2007 |
| DE | 102010033646 | 8/2011 |
| EP | 0693539 | 1/1996 |
| EP | 1207190 | 5/2002 |
| EP | 1207191 | 5/2002 |
| EP | 1462505 | 9/2004 |
| EP | 1865046 | 12/2007 |
| EP | 2 281 864 | 8/2009 |
| FR | 2965816 | 4/2013 |
| JP | 6 500134 | 6/1994 |
| JP | 200505123 | 4/2000 |
| JP | 2008280411 | 11/2008 |
| WO | 9202599 | 2/1992 |
| WO | 9923431 | 5/1999 |
| WO | 0151591 | 7/2001 |
| WO | 0240618 | 5/2002 |
| WO | 0246332 | 6/2002 |
| WO | 2006128285 | 12/2006 |
| WO | 2007002844 | 1/2007 |
| WO | 2008059109 | 5/2008 |
| WO | 2008145814 | 12/2008 |
| WO | 2009020442 | 2/2009 |
| WO | 2011101022 | 8/2011 |

OTHER PUBLICATIONS

International Search Report, Appln No. PCT/EP2013/002765, Big Dutchman International GmbH (Jan. 21, 2014) (German language only).

International Search Report, Appln No. PCT/EP2010/051947 (Apr. 18, 2011).

Japanese Patent Office Action, Japanese Patent Appln No. 2012-553193, Big Dutchman International GmbH (Apr. 1, 2014) (with summary translation only).

Written Opinion Appln No. PCT/EP2010/051947 (May 14, 2014).

Preliminary Report, Appln No. PCT/EP2010/051947 (Jul. 2, 2012).

Russian Patent Office Action, Russian Patent Appln No. 2012139452, Big Dutchman International GmbH (May 12, 2014).

State Intellectual property Office of People's Republic of China, Second Office Action in Appln No. 201280014402.6, Applicant Big Dutchman International GmbH (Mar. 10, 2015) (translated).

International Search Report, PCT App. No. PCT/EP2012/055082 dated Jul. 2, 2012.

* cited by examiner

SHAFT GASIFIER FOR OPERATING WITH HYPOSTOICHIOMETRIC OXIDATION

The invention relates to a shaft gasifier for producing fuel gas from solid carbonaceous material, said shaft gasifier comprising a shaft wall surrounding a shaft gasifier interior, a pyrolysis zone disposed in the shaft gasifier interior, said pyrolysis zone comprising a solid material feed opening for feeding solid carbonaceous material into the shaft gasifier and a solid material discharge opening for discharging partially gasified solid carbonaceous material and a gas discharge opening for pyrolysis gas, an oxidation zone which is disposed in the shaft gasifier interior and which is in thermal contact with the pyrolysis zone, said oxidation zone comprising a gas feed opening connected to the gas discharge opening of the pyrolysis zone for discharging pyrolysis gas out of the pyrolysis zone, and a gas discharge opening. Another aspect of the invention concerns a method of producing fuel gas from solid carbonaceous material.

Shaft gasifiers of the aforementioned kind are used to produce combustible gas from solid carbonaceous material, for example from biological waste or plant cuttings in unprocessed or mechanically processed or pelletised form. Shaft gasifiers of this kind are basically designed in such a way that the solid material is subjected to a pyrolysis reaction under the effect of heat, as a result of which it is gasified, said gas being removed as fuel gas.

Such a shaft gasifier and gasification method are known from EP 1 865 046 A1, in which the pyrolised gas is fed to an oxidation zone in order to partially combust it there. The oxidation zone is disposed centrally in the shaft gasifier. This arrangement and method has the advantage that temperature is generated in the oxidation zone from the pyrolysis gas, and that this temperature can be transmitted efficiently by thermal conduction into the pyrolysis zone to drive the pyrolysis process there. The shaft gasifier with this constructional design is therefore able to gasify efficiently and to produce fuel gas without having to supply a temperature from the outside.

Gasification of solid biological materials is becoming increasingly important in connection with the generation of power from renewable energy sources. One result of this increasing importance is a need for shaft gasifiers which can gasify large amounts of solid material efficiently and in a short time. Principles known from the prior art, such as the gasification principle known from EP 1 865 046 A, and the associated construction design of the shaft gasifier, can basically be scaled up in order to increase the throughput volume and the amount of gas produced per unit of time. However, this scaling is subject to limits, because from a particular size onwards, efficient gasification of the solid is no longer assured, or because the sub-processes required for gasification, such as pyrolysis and oxidation, can no longer be adjusted to an ideal value or to an ideal range of values over the entire volume of the solid material and volumes of gas. The consequence of upscaling arbitrarily is therefore that the efficiency of the shaft gasifier and of the gasification processes occurring therein declines due to lack of adjustment to the ideal operating values.

The object of the invention is to provide a shaft gasifier and a gasification method with which an enhanced throughput of solid material can be achieved without loss of efficiency or at least with less loss of efficiency in the gasification process than is the case in prior art shaft gasifiers and gasification methods.

This object is achieved, according to the invention, with a shaft gasifier of the kind initially specified, in which the oxidation zone is disposed between the pyrolysis zone and the shaft wall.

By means of the shaft gasifier according to the invention, the prior art arrangement with an oxidation chamber disposed centrally in the shaft gasifier and with an annular pyrolysis zone disposed around the oxidation chamber inside the shaft gasifier is reversed, with the pyrolysis zone being centrally disposed in the shaft gasifier and the oxidation zone being disposed around said pyrolysis zone. This inverse arrangement seems at first glance to be disadvantageous for efficiency reasons, since the desired recovery of heat out of the oxidation zone into the pyrolysis zone is only assured with a centrally disposed oxidation zone that is surrounded on all sides by the pyrolysis zone, whereas an annular oxidation zone disposed around the pyrolysis zone has a large, heat-emitting outer surface that is not used to heat the pyrolysis zone. However, the inventors realised that disposing the oxidation zone between the pyrolysis zone and the shaft wall allows the shaft gasifier to be designed in such a way that the throughput volume of solid material can be increased not only by increasing the size of the pyrolysis zone, but also by providing a plurality of pyrolysis zones in the shaft gasifier. The inventive arrangement thus allows scaling by increasing the number of pyrolysis zones and not solely by increasing the size of the pyrolysis zone. Despite substantial increase in the throughput volume of solid material, this makes it possible to maintain efficient adjustment of the shaft gasifier to the ideal operating point and consequently to gasify the increased amount of solid material with a efficient process management. For example, it is possible for two or more pyrolysis zones in the form of pipes to be arranged lengthwise and spaced apart from each other in the shaft gasifier, into which solid material is filled from above, and from which pyrolysis gas is recovered that then passes through radial openings in the pipes to enter the oxidation zone which is formed by the rest of the shaft gasifier cross-section between the pipes and the shaft gasifier wall.

It should be understood, as a basic principle, that the shaft gasifier according to the invention may be configured with individual openings for feeding and discharging solid material and for feeding and discharging gas, but that it is basically advantageous to provide a plurality of such openings to ensure that material is guided in an ideal manner inside the shaft gasifier. It should also be understood, as a basic principle, that the process zones, that is to say the pyrolysis zone, the oxidation zone and the like, may be separated from each other by walls inside the shaft gasifier, but may also be formed, however, in a common space not divided by walls, for example by boundaries being formed between a gas space and a solid material space by the way that solid material is guided and by the force of gravity or by the manner of discharge, and that functionally different zones are formed as a result.

The shaft gasifier has the basic advantage that the channelling and transportation of the solid material inside the shaft gasifier can be accomplished without actively operated conveying means, by the solid material slipping down from top to bottom inside the shaft gasifier under the force of gravity and thus being subjected to gasification. The shaft gasifier can also be operated with the oxygen from ambient air, by providing appropriate openings for feeding fresh air into the oxidation zone. The feeding of fresh air can be be forced by actively extracting the fuel gas from the shaft gasifier and by a resultant underpressure produced in the shaft gasifier interior.

According to a first preferred embodiment, the shaft gasifier according to the invention is developed by a reduction zone disposed in the shaft gasifier interior and having a solid material feed opening which is connected to the solid material discharge opening of the pyrolysis zone in order to feed partially gasified solid carbonaceous material into the reduction zone, a solid material discharge opening for discharging gasified solid carbonaceous material out of the shaft gasifier, a gas feed opening connected to the gas discharge opening of the oxidation zone for feeding partially oxidised pyrolysis gas from the oxidation zone into the reduction zone, and a gas discharge opening for extracting fuel gas from the shaft gasifier.

With this embodiment, the shaft gasifier is improved still further in respect of efficiency and the quality of fuel gas. This is done by providing a reduction zone into which the partially gasified solid is fed, said reduction zone preferably being positioned in such a way that the solid material moves out of the pyrolysis zone solely by the force of gravity into the reduction zone, without passing through the oxidation zone. The partially gasified solid material can then be supported on a grate in the reduction zone in order to build up a flow resistance therein. The reduction zone is also disposed in such a way that it is in direct flow connection with the oxidation zone, such that fuel gas which is partially oxidised in the oxidation zone can reach the reduction zone directly and by bypassing the pyrolysis zone. This partially oxidised pyrolysis gas is then reduced in the reduction zone by a chemical reaction with the partially gasified solid material or reduction coke therein. In this way, the partially oxidised pyrolysis gas is improved with regard to its calorific value and also cleaned, and can then be extracted from the reduction zone as a high-quality fuel gas from which impurities have largely been removed.

The reduction zone plays a key role in controlling the gasification process in the shaft gasifier; the height of the cake of solid material in the reduction zone, which determines the flow path of the partially oxidised pyrolysis gas through the solid portion in the reduction zone, and also the flow cross-section available for this purpose, are two factors among others. It is advantageous in this regard if the height of the solid material in the reduction zone can be controlled during the ongoing process, for example by changing the loading height, as will be described in more detail below with reference to a constructional embodiment, or if the discharged volume of fully gasified solid material can be controlled, for example by actuating a vibrating grate at the bottom end of the reduction zone, by actuating the vibrating gate and by changing this actuation periodically and in its intensity.

It is further preferred, in a shaft gasifier having a reduction zone, that the reduction zone be disposed in the direction of gravity underneath the pyrolysis zone so that solid material can be fed from the pyrolysis zone into the reduction zone under the force of gravity.

This embodiment allows robust yet economical operation of the shaft gasifier according to the invention. Feeding material under the influence of gravity or solely by the force of gravity, or a similar form of material transport, is to be generally understood here within the meaning of this description and the claims to mean that the material slips from one zone into the other zone under the influence of gravity or solely under the force of gravity, and that it also moves inside the respective zones under the influence of gravity. This conveying principle avoids the necessity of conveying devices. However, it does not exclude the possibility of wall portions or fixtures being moved into or between these respective zones, for example rotated or shaken, in order to prevent adhesion to said walls and thus to main and/or to support the flow of material under the influence of gravity. Fixtures used for homogenisation or for mixing the conveyed material in order to release clamping effects, blockages or wedging of the conveyed material that would stand in the way of conveying under the influence of gravity, are likewise not excluded from this kind of material flow.

According to another preferred embodiment, two or more pyrolysis zones are arranged at a distance from each other inside the shaft gasifier interior and one or more oxidation zones are arranged between the two or more pyrolysis zones and between the pyrolysis zones and the shaft wall.

With this embodiment, a particularly advantageous design of the shaft gasifier is proposed that has already been described as one of the advantageous options. A plurality of pyrolysis zones are arranged at a distance from each other in the shaft gasifier interior and are supplied separately with solid material from separate or from one shared feed device. Around these pyrolysis zones, an oxidation zone is formed which extends between the respective pyrolysis zones and between the pyrolysis zones and the shaft gasifier wall. This oxidation zone can also be subdivided into a plurality of oxidation zones, and this subdivision may actually be implemented constructionally by appropriate partition walls or the subdivision may be implemented with control engineering systematics, without using any actual constructional partitions, for example by arranging and distributing a plurality of temperature sensors in the oxidation zone which detect the temperature in different oxidation subzones and by using the signals from these sensors to control parameters affecting temperature in one or more specific pyrolysis zones and/or one or more oxidation zones, but not for controlling parameters that are set in all oxidation subzones and/or pyrolysis zones.

The shaft gasifier according to the invention can be further developed by a pyrolysis gas conduit which is adapted to guide the pyrolysis gas produced in the pyrolysis zone out of the pyrolysis zone, upwards at a distance from the pyrolysis zone, and which is adapted to open into the upper part of the oxidation zone in the direction of gravity.

With this development of the invention, the pyrolysis gas is guided in such a way that it does not have adverse effects, due to its distance from the pyrolysis zone, on the thermal contact between the oxidation zone and the pyrolysis zone, the result being a shaft gasifier in which heat is transferred highly efficiently out of the oxidation zone into the pyrolysis zone. The pyrolysis gas conduit may be realised by one or more pipes or passageways or the like, which run in the appropriate manner. It should be assumed here as a basic principle that the pyrolysis gas is extracted from the pyrolysis zone in a region which lies underneath the pyrolysis zone in the direction of gravity and must then be guided upwards inside the shaft gasifier against the direction of gravity in order to pass from top to bottom through the oxidation zone in the direction of gravity. Alternatively, however, the pyrolysis gas conduit can also be routed as a basic principle in such a way that the oxidation zone is passed through against the direction of gravity, which means that gas exiting the oxidation zone is then guided downwards from top to bottom and discharged into a reduction zone, if one is present. In this case, the pyrolysis gas can be extracted from the pyrolysis zone without needing a long conduit, and discharged into the oxidation zone at the same height.

According to another preferred embodiment, the solid material discharge opening of the pyrolysis zone can be guided vertically movably in the shaft gasifier and can be positioned in at least two positions at different heights inside the shaft gasifier.

This constructional design makes it possible to vary the height at which the partially gasified solid material leaves the pyrolysis zone and enters a reduction zone that may be provided thereunder. In this way, the height of the solid material bulk in the reduction zone can be controlled, and this height has an influence on the entire process management in the shaft gasifier according to the invention, due to the associated gas route through the reduction zone and the concomitant flow resistance. The vertical mobility of the solid material discharge opening may be realised in such a way, for example, that this solid material discharge opening is formed at a lower end of a pipe or shaft, and that this pipe or shaft is disposed vertically movably in the shaft gasifier.

It is still further preferred that the solid material feed opening of the pyrolysis zone can be guided vertically movably in the shaft gasifier and can be positioned in at least two positions at different heights inside the shaft gasifier.

This development of the inventions allows the solid material to be fed into the pyrolysis zone at different heights, thus allowing the amount of solid material and the height of the solid material in the pyrolysis zone to be controlled. This then allows an important parameter for the process inside the shaft gasifier to be influenced, in order to control in an optimal manner the partial gasification process in the pyrolysis zone and thus the overall efficiency of the shaft gasifier.

In one constructional implementation of this principle, the solid material is fed to the pyrolysis zone via a pipe or passageway that feeds the solid material at its bottom end into the pyrolysis zone, said pipe or passageway being disposed vertically movably in the shaft gasifier.

It is also particularly preferred, with a combination of the two preferred embodiments described above, when the solid material feed opening of the pyrolysis zone includes an axial opening of a solid material feed pipe which is disposed inside a pyrolysis pipe, and that the solid material discharge opening of the pyrolysis zone includes an axial opening of the pyrolysis pipe. In this configuration, a pipe or passageway design is chosen for the solid material supply and the pyrolysis zone, in which a solid material feed pipe having an axial opening at the bottom is guided inside a pyrolysis pipe, said pyrolysis pipe having a lower axial opening which lies underneath the opening in the solid material feed pipe in the direction of gravity. In this way, the pyrolysis zone is formed in the pyrolysis pipe between the lower end of the solid material feed pipe and the lower end of the pyrolysis pipe. By vertically moving the solid material feed pipe, the height of said pyrolysis zone can be varied, so it is possible to increase the height of the pyrolysis zone by lifting the solid material feed pipe. By vertically moving the pyrolysis pipe and the solid material feed pipe together, the height at which the partially gasified solid material is discharged from the pyrolysis zone can be varied while keeping the height of the pyrolysis zone constant, thus allowing the height of a solid material bulk in a reduction zone disposed underneath the pyrolysis zone to be varied. It is also possible to change the height of the pyrolysis zone and the reduction zone inversely in relation to each other with a stationary solid material feed pipe, as a result of which the gasification process can be shifted out of the pyrolysis zone and into the reduction zone in an appropriate ratio, and vice versa, in order to respond in this way to the specific gasification behaviour of different solids.

In order to solve the problem addressed by the invention, the shaft gasifier according to the invention or the shaft gasifier of the kind initially specified can be further developed by providing a temperature sensor for detecting the temperature in the oxidation zone, an air feed device for increasing and/or lowering the amount of gas containing oxygen being fed to the oxidation zone, and a regulating device in signal communication with the temperature sensor and the air feed device and adapted to regulate hypostoichiometric combustion in the oxidation zone by actuating the air feed device according to the signal from the temperature sensor on the basis of an allocation stored in an electronic memory device of the regulating device.

By means of such a regulating device with a temperature sensor and a controllable air feed device, the shaft gasifier according to the invention can also be operated at an ideal operating point with large dimensions for the pyrolysis zone, the oxidation zone and any reduction zone that is present, thus maintaining the efficiency of the shaft gasifier even when its dimensions are highly upscaled. By controlling the amount of air supply, direct influence is exerted on the combustion of the pyrolysis gas in the oxidation zone. If hypostoichiometric combustion occurs here, it is possible to increase or decrease the temperature by increasing or decreasing the supply of air, respectively, since providing more or less oxygen results accordingly in more intensive or in choked combustion occurring here. The air feed device can be implemented by providing one or more control valves for opening or choking the air feed passageways into the oxidation zone, in the simplest case by providing appropriate slide valves or flap valves that allow robust implementation and reliable functioning. It should be understood, as a basic principle, that providing more than one temperature sensor also allows the process in the shaft gasifier to be monitored more precisely. The temperature sensor may be disposed primarily in the oxidation zone itself, in order to detect the temperature therein. In other embodiments, one or more temperature sensors may be provided alternatively, or also cumulatively, in other regions of the shaft gasifier, for example in the pyrolysis zone or in a reduction zone, in order to measure the temperature therein and to allow conclusions to be inferred about the temperature in the oxidation zone. Such an embodiment is also to be understood, within the meaning of the invention, as a temperature sensor for detecting the temperature in the oxidation zone.

It is further preferred in this regard that the regulating device be adapted to actuate the air feed device on the basis of the stored allocation such that the air supply is increased when the signal indicates a temperature which is below a predetermined setpoint temperature, and the air supply is reduced when the signal indicates a temperature which is above a predetermined setpoint temperature.

When the regulating device shows this control response, combustion in the oxidation zone can be adjusted on the basis of the temperature to a predetermined, hypostoichiometric combustion ratio. The regulating device and the allocation stored therein make use of the principle that an increase in temperature can be achieved under hypostoichiometric combustion conditions when more air is supplied, since combustion in that case approximates to the stoichiometrically ideal ratio and, conversely, the temperature can be reduced when the supply of air is choked, as a result of which less combustion occurs due to a surplus of fuel gas.

In another preferred embodiment having the regulating device according to the invention, the regulating device is adapted to alter the setpoint temperature at regular intervals by a predetermined amount and to establish, on the basis of the control response for reaching the altered setpoint temperature, whether hypostoichiometric or hyperstoichiometric combustion is occurring in the oxidation zone, and to set the air supply anew such that adjustment to hypostoichiometric combustion is made, in particular by: setting the setpoint temperature back by the predetermined amount to the setpoint temperature prior to the change, if hypostoichiometric combustion was established on the basis of the control response, or by reducing the air supply until the modified setpoint temperature is reached, if hyperstoichiometric combustion was established on the basis of the control response.

This configuration solves a specific problem, namely that a particular temperature may occur not only when combustion is hypostoichiometric, but also in the case of hyperstoichiometric combustion in the oxidation zone. In both cases, the temperature is less than the combustion temperature achieved in the case of stoichiometric combustion. However, the temperature in the one case lies to the left and in the other case to the right of the maximum of a curve, in which the temperature is set using the combustion ratio and the maximum is achieved with stoichiometric combustion. By altering the setpoint temperature in accordance with the invention, the regulating device is forced to perform specific, periodic regulation. Altering the setpoint temperature results in a control process based, for example, on a control response which would be expected in the hypostoichiometric combustion range. If, for example, the setpoint temperature were lowered and too high a temperature were measured, resulting in the supply of air being reduced in order to adjust the temperature to the setpoint temperature. The regulating device can then establish, on the basis of the temperature response to the regulation process, whether hypostoichiometric or hyperstoichiometric combustion is occurring in the oxidation zone. If the temperature falls in response to the supply of air being choked, combustion is hypostoichiometric. If, in contrast, the temperature rises in response to the supply of air being choked, then combustion is hyperstoichiometric and combustion conditions approach stoichiometric combustion.

In response to the respective finding, this regulating device can initiate corrective action that results in hypostoichiometric combustion being maintained or adjusted. In the first case, all that is necessary is to reset the temperature to the original setpoint value applying before the change, in order to achieve the ideal hypostoichiometric combustion conditions being aimed for. In the second case, regulation "to the left" is necessary when the supply of air is continuously reduced, until the temperature maximum is crossed and the setpoint temperature is reached. Not until the setpoint temperature has been reached can a normal control response with increasing and choking of the air supply be set again, after which the setpoint temperature is reset to the original value applying before the change.

In another preferred embodiment of this aforementioned regulating device, the regulating device is adapted to reduce the setpoint temperature at regular intervals by a predetermined amount and to establish hypostoichiometric combustion in the oxidation zone if the actual temperature rises when the supply of air increases, or to establish hyperstoichiometric combustion in the oxidation zone if the actual temperature falls when the supply of air is increased, the regulating device being further adapted to then set the air supply anew, depending on the result of such ascertainment, such that adjustment to hypostoichiometric combustion is made, by increasing the setpoint temperature again by the predetermined amount, if hypostoichiometric combustion was established on the basis of the control response, or by reducing the air supply until the modified setpoint temperature is reached, if hyperstoichiometric combustion was established on the basis of the control response.

With this development of the invention, specific hypostoichiometric conditions are set, and checks are performed at regular intervals, by lowering the setpoint temperature to the desired ideal value, to determine whether hypostoichiometric combustion conditions are being maintained. If necessary, further corrections are made in the manner described in the foregoing.

Another aspect of the invention relates to a method of producing fuel gas from solid carbonaceous material, said method comprising the steps of: feeding solid carbonaceous material into a pyrolysis zone disposed in a shaft gasifier interior, feeding pyrolysis gas from the pyrolysis zone into an oxidation zone disposed in the shaft gasifier interior, wherein the pyrolysis gas is guided out of the pyrolysis zone radially outwards into the oxidation zone.

The method according to the invention is characterised by an advantageous way of channelling the gas inside the shaft gasifier, which allows the method to be easily upscaled to large throughput volumes. The method can preferably be carried out using a shaft gasifier of the kind described above.

The method can be developed by the steps of: feeding partially gasified solid carbonaceous material from the pyrolysis zone into a reduction zone disposed in the shaft gasifier interior, in particular by bypassing the oxidation zone, feeding partially oxidised pyrolysis gas from the oxidation zone into the reduction zone, and extracting fuel gas from the reduction zone.

This preferred embodiment achieves a qualitative improvement in the fuel gas while simultaneously increasing the calorific value by reducing the solid material to partially gasified solid material from which the pyrolysis gas has been partially oxidised in the oxidation zone.

Another variant of the method comprises the steps of: detecting the temperature in the oxidation zone by means of a temperature sensor, increasing and/or decreasing the supply of gas containing oxygen to the oxidation zone by means of an air feed device, and adjusting hypostoichiometric combustion in the oxidation zone by means of a regulating device in signal communication with the temperature sensor and the air feed device, by controlling the amount of air supply according to the signal from the temperature sensor, on the basis of an allocation stored in an electronic memory device of the regulating device.

With this development of the invention, a particularly efficient method of regulation is proposed which is able to set and maintain an ideal operating point inside a shaft gasifier, even for large throughput volumes.

It is particularly preferred in this regard when the following steps are additionally performed in accordance with the invention: altering the setpoint temperature at regular intervals by a predetermined amount, establishing on the basis of the control response for reaching the altered setpoint temperature whether hypostoichiometric or hyperstoichiometric combustion is occurring in the oxidation zone, and setting the air supply such that adjustment to hypostoichiometric combustion is made, in particular by: setting the setpoint temperature back by the predetermined amount to the setpoint temperature prior to the change, if hypostoichiometric combustion was established on the basis of the control response, or by reducing the air supply until the modified setpoint temperature is reached, if hyperstoichiometric combustion was established on the basis of the control response.

With this development of the invention, a method is proposed which takes into consideration that a particular temperature may occur not only when combustion in the oxidation zone is hypostoichiometric, but also in the case of hyperstoichiometric combustion in the oxidation zone, for which reason a regulation mechanism is proposed that checks at regular intervals by changing the setpoint temperature, in particular by lowering the setpoint temperature, to determine whether hypostoichiometric combustion conditions are present, and which takes corrective action, if necessary, in the manner described in the foregoing.

Figure 2:
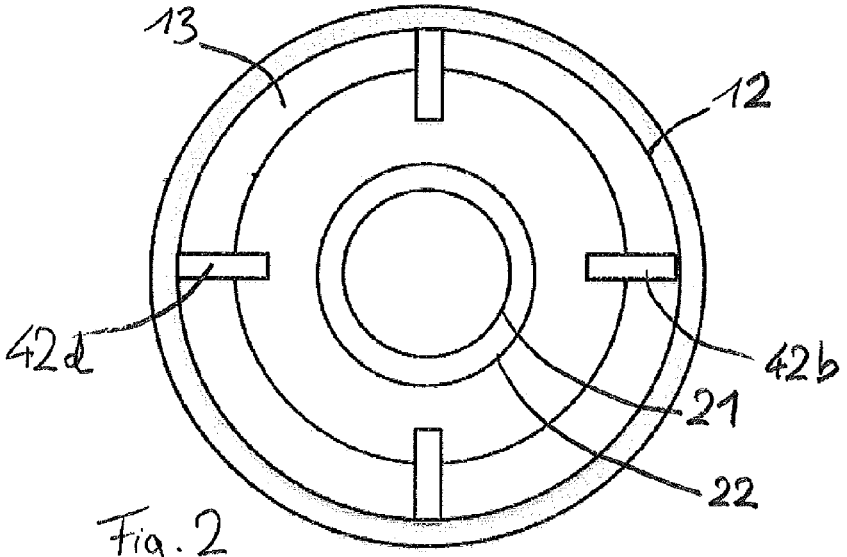
Figure 3:
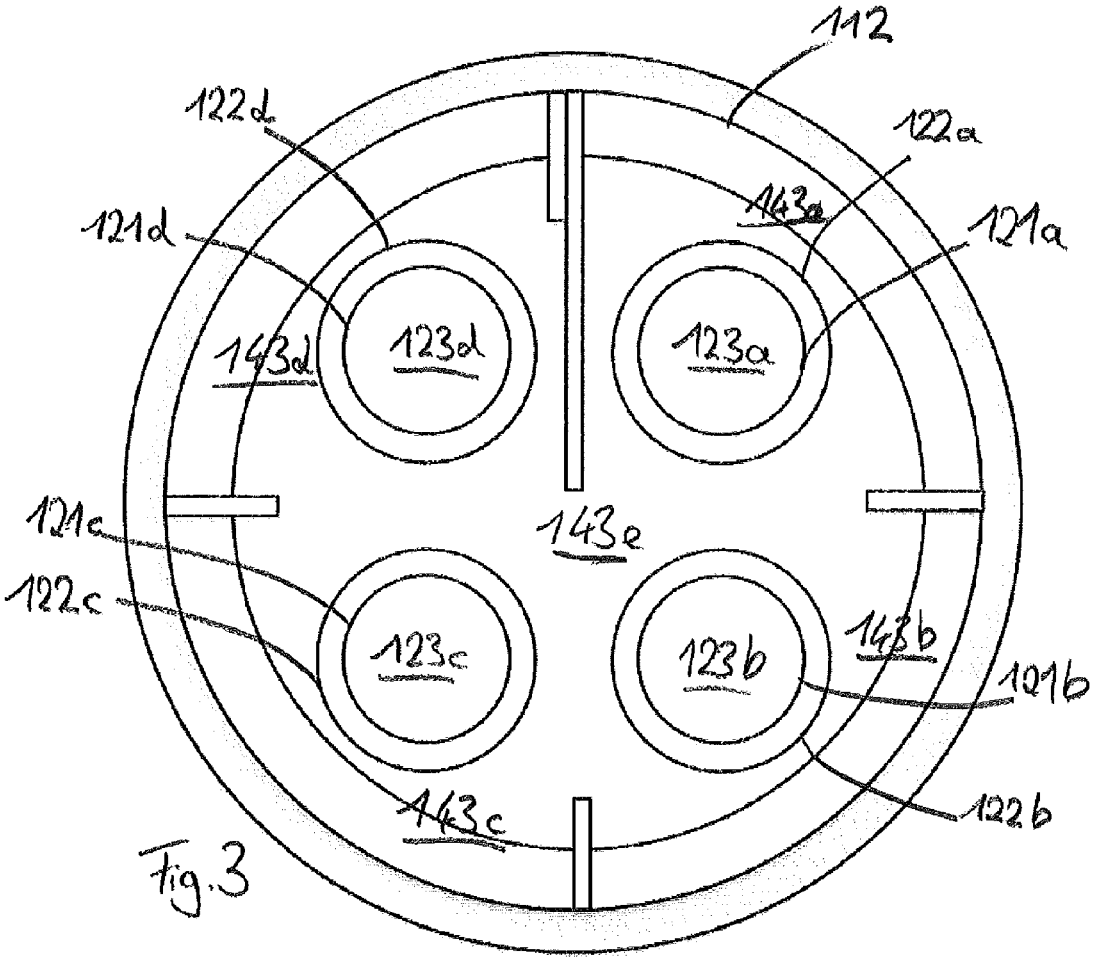

Preferred embodiments of the invention shall now be described with reference to the attached Figures, in which:

FIG. 1 shows a schematic, longitudinal cross-sectional side view of a shaft gasifier according to a first embodiment of the invention, FIG. 2 shows a cross section along line A-A in FIG. 1, and FIG. 3 shows a cross-section as in FIG. 2 through a second embodiment of a shaft gasifier according to the invention.

The shaft gasifier according to FIGS. 1 and 2 is enclosed laterally and at the top by a thermally insulated shaft wall 11, 12 and is circular in cross-section. A double pipe arrangement 20 extends through the upper end face of shaft wall 11. Said double pipe arrangement 20 comprises an inner solid material feed pipe 21, which is connected at its upper end to a screw conveyor device 30 running transversely to the longitudinal axis of the shaft gasifier. Solid material can be guided via screw conveyor device 30 from above into solid material feed pipe 21 and falls downwards inside the solid material feed pipe.

Solid material feed pipe 21 is disposed inside a pyrolysis pipe 22. The pyrolysis pipe extends further into the shaft gasifier interior than solid material feed pipe 21, as a result of which the bottom end face opening 21*a* of the solid material feed pipe comes to lie inside the pyrolysis pipe. Solid material exiting this bottom opening 21*a* fills pyrolysis zone 23 lying between the discharge opening 21*a* of solid material feed pipe 21 and a pyrolysis pipe opening 22*a* formed at the bottom end of pyrolysis pipe 22.

In the upper region of the pyrolysis pipe, but inside the shaft gasifier, radial openings 24 are arranged in the pyrolysis pipe. These opening are provided so that pyrolysis gas can pass out of pyrolysis zone 23 into an oxidation zone 43. Oxidation zone 43 is annularly disposed around the pyrolysis pipe and is outwardly defined by shaft gasifier wall 12. The oxidation zone extends across the entire length of the pyrolysis pipe 22 lying inside the shaft gasifier.

Four air supply lines 41 *a-d* extend from the surroundings into the oxidation zone and feed air containing oxygen into the oxidation zone. Each of the four fresh air supply lines 41 *a-d* are provided at the outer end with a controllable choke valve 42 *a-d*, by means of which the amount of air supplied through the respective air supply pipe can be reduced or increased.

Partially gasified solid material is discharged downwards out of pyrolysis pipe opening 22*a* and forms a reduction coke cone 53. Said reduction coke cone 53 is laterally confined by a sheet metal hopper 13 disposed inside the shaft gasifier, and widens again underneath sheet metal hopper 13 and finally opens into a bottom discharge hopper 14 into a discharge opening 14*a*, which opens into a screw conveyor device 60. Ash can be removed from the shaft gasifier by means of screw conveyor device 60. The amount of ash removed can be adjusted by controlling the speed at which the screw conveyor device rotates.

A circumferential cavity 55 is disposed in the region between external wall 12 and reduction zone hopper 13. Fuel gas from the reduction zone can be extracted from said cavity 55 to the outside by means of an extraction opening 56 through shaft gasifier wall 12.

Suction of the fuel gas through extraction opening 56 is the only gas transportation movement that is actively performed at the shaft gasifier. Due to the underpressure produced as a result in reduction zone 53, the partially oxidised pyrolysis gas is sucked out of the oxidation zone 43 into the reduction zone and in addition, due to the underpressure subsequently produced in oxidation zone 43, the pyrolysis gas is sucked out of pyrolysis zone 23 through the annular cavity between the solid material feed pipe and the pyrolysis pipe to the radial openings 24 in the pyrolysis pipe, from whence it is drawn into the oxidation zone. As a result of the underpressure produced in the oxidation zone by extraction of the fuel gas, fresh air is likewise sucked into the oxidation zone through fresh air supply lines 41 *a-d*, and said supply of fresh air can be controlled by airflow control devices 42 *a-d*.

A temperature sensor 45 *a, b* is disposed in the oxidation zone on either side of the pyrolysis pipe and detects the temperature in the oxidation zone. Temperature sensor 45*a, b* is connected to a regulating device which actuates choke valves 42 *a-d*. If the regulating device establishes that the setpoint temperature is too low, the supply of air is increased, and if the regulating device establishes that the temperature is too high, the supply of air is reduced. The setpoint temperature is lowered at regular intervals and the control response is observed. If, as a result of the reduction in setpoint temperature, the actual temperature is also reduced due to a control response involving a reduction in air supply, the regulating device sets a desired hypostoichiometric combustion ratio in the oxidation zone and then returns to the original setpoint temperature. If, in contrast, the regulating device establishes that the actual temperature in the oxidation zone rises as a result of the control response following reduction in setpoint temperature, it sets a hyperstoichiometric combustion ratio and performs corrective active by regulating combustion "to the left", wherein the maximum temperature at the stoichiometric combustion ratio is passed through under ongoing reduction in the air supply, and the temperature is adjusted to the setpoint temperature with further reduction in the air supply in the normal control response in the hypostoichiometric range. After reaching the setpoint temperature, the original temperature is then reset in this case also. This control process is repeated at regular intervals of two hours.

Both solid material feed pipe 21 and pyrolysis pipe 22 are vertically adjustable. By raising the pyrolysis pipe, reduction zone 53 can be enlarged with simultaneous shrinkage of pyrolysis zone 23. If the solid material feed pipe is raised and the pyrolysis pipe is fixed in place, only the pyrolysis zone is enlarged. If the solid material feed pipe and the pyrolysis pipe are raised simultaneously, reduction zone 53 is enlarged and the size of pyrolysis zone 23 remains the same. Conversely, by inserting both pipes 21, 22 accordingly in the opposite direction, it is possible to reduce the size of the pyrolysis zone and/or the reduction zone.

FIG. 3 shows a second embodiment of the invention. This embodiment differs from the first embodiment in that, instead of a single pyrolysis zone 23, a plurality of pyrolysis zones 123 *a, b, c, d* are arranged in a single shaft gasifier. This plurality of pyrolysis zones 123 *a-d* are defined by a respective plurality of pyrolysis pipes 122 *a-d*, each having a solid material feed pipe 121*a-d* disposed therein. Each of the solid material feed pipes 121*a-d* is connected to two solid material screw conveyors such that each solid material screw conveyor supplies two solid material feed pipes with solid material.

An oxidation zone 143 *a-e* is disposed between the individual pyrolysis zones and between the pyrolysis zones and outer shaft wall 112.

A reduction zone, formed by a plurality of amalgamating coke cones, is also formed underneath the pyrolysis zone. The height of these coke cones can be controlled by raising or lowering the pyrolysis pipe, and the individual pyrolysis pipes 121*a-c* may be raised or lowered simultaneously or separately.

The functional principle of the shaft gasifier according to FIG. 3 does not differ from that of the shaft gasifier according to FIG. 1, but due to the plurality of pyrolysis zones it can achieve a substantially higher throughput of solid material with efficient gasification and thus a substantially higher level of fuel gas production.

The invention claimed is:

1. A shaft gasifier for producing fuel gas from solid carbonaceous material, the shaft gasifier comprising:

a shaft wall surrounding a shaft gasifier interior;

a pyrolysis zone disposed in the shaft gasifier, the pyrolysis zone comprising a solid material feed pipe with a solid material feed opening at its bottom for feeding solid carbonaceous material into the shaft gasifier, a pyrolysis pipe with a solid material discharge opening for discharging partially gasified solid carbonaceous material, wherein the pyrolysis pipe extends further into the shaft gasifier interior than the solid material feed pipe, a pyrolysis gas conduit located in an annular space between the solid material feed pipe and pyrolysis pipe, and a gas discharge opening for pyrolysis gas toward the top of the pyrolysis pipe in fluid communication with the pyrolysis gas conduit, an oxidation zone which is disposed in the shaft gasifier and which is in thermal contact with the pyrolysis zone, said oxidation zone comprising:

a gas feed opening connected to the gas discharge opening of the pyrolysis zone for discharging pyrolysis gas out of the pyrolysis zone, a gas discharge opening;

wherein the oxidation zone is disposed between the pyrolysis zone and the shaft wall.

2. The shaft gasifier according to claim 1, further comprising a reduction zone disposed in the shaft gasifier interior, the reduction zone comprising:

a solid material feed opening connected to the solid material discharge opening of the pyrolysis zone for feeding partially gasified solid carbonaceous material into the reduction zone, a solid material discharge opening for discharging partially gasified solid carbonaceous material out of the shaft gasifier, a gas feed opening connected to the gas discharge opening of the oxidation zone for feeding partially oxidised pyrolysis gas from the oxidation zone into the reduction zone, and a gas discharge opening for extracting fuel gas from the shaft gasifier.

3. The shaft gasifier according to claim 2, wherein the reduction zone is disposed in the direction of gravity underneath the pyrolysis zone so that solid material can be fed from the pyrolysis zone into the reduction zone under the force of gravity.

4. The shaft gasifier according to claim 1, further comprising two or more pyrolysis zones arranged at a distance from each other inside the shaft gasifier interior and one or more oxidation zones are arranged between the two or more pyrolysis zones and between the pyrolysis zones and the shaft wall.

5. The shaft gasifier according to claim 1, wherein the solid material discharge opening of the pyrolysis zone can be guided vertically movably in the shaft gasifier and can be positioned in at least two positions at different heights inside the shaft gasifier.

6. The shaft gasifier according to claim 1, wherein the solid material feed opening of the pyrolysis zone can be guided vertically movably in the shaft gasifier and can be positioned in at least two positions at different heights inside the shaft gasifier.

7. The shaft gasifier according to claim 1, further comprising:

a temperature sensor for detecting the temperature in the oxidation zone, an air feed device for increasing and/or lowering regulating the amount of gas containing oxygen being fed to the oxidation zone, and a regulating device in signal communication with the temperature sensor and the air feed device and adapted to regulate hypostoichiometric combustion in the oxidation zone by actuating the air feed device according to the signal from the temperature sensor on the basis of an allocation stored in an electronic memory device of the regulating device.

8. The shaft gasifier according to claim 7, wherein the regulating device is adapted to actuate the air feed device on the basis of the stored allocation such that the air supply is increased when the signal indicates a temperature which is below a predetermined setpoint temperature, and the air supply is reduced when the signal indicates a temperature which is above a predetermined setpoint temperature.

9. The shaft gasifier according to claim 7, wherein the regulating device is configured to alter the setpoint temperature at regular intervals by a predetermined amount and establish, on the basis of the control response for reaching the altered setpoint temperature, whether hypostoichiometric or hyperstoichiometric combustion is occurring in the oxidation zone, and then, depending on the result, to set the air supply anew such that adjustment to hypostoichiometric combustion is made by:

setting the setpoint temperature back by the predetermined amount to the setpoint temperature prior to the change, if hypostoichiometric combustion was established on the basis of the control response, or by reducing the air supply until the modified setpoint temperature is reached, if hyperstoichiometric combustion was established on the basis of the control response.

10. The shaft gasifier according to claim 9, wherein the regulating device is adapted to alter the setpoint temperature at regular intervals by a predetermined amount and to establish hypostoichiometric combustion in the oxidation zone if the actual temperature rises when the air supply is increased, or to establish hyperstoichiometric combustion in the oxidation zone if the actual temperature falls when the air supply is increased, and the regulating device is further adapted to then set the air supply anew, depending on the result of such ascertainment, such that adjustment to hypostoichiometric combustion is made:

by increasing the setpoint temperature again by the predetermined amount, if hypostoichiometric combustion was established on the basis of the control response, or by reducing the air supply until the modified setpoint temperature is reached, if hyperstoichiometric combustion was established on the basis of the control response.

* * * * *